US006249225B1

(12) United States Patent
Wang

(10) Patent No.: US 6,249,225 B1
(45) Date of Patent: Jun. 19, 2001

(54) AUXILIARY ALERT PROCESS AND SYSTEM THEREOF FOR ALARM SYSTEM

(76) Inventor: Randall Wang, 5209 N. Tyler Ave., Temple City, CA (US) 91780

( * ) Notice: Subject to any disclaimer, the term of this patent is extended or adjusted under 35 U.S.C. 154(b) by 0 days.

(21) Appl. No.: 09/221,611

(22) Filed: Dec. 28, 1998

(51) Int. Cl.[7] ..... G08B 13/08

(52) U.S. Cl. ..... 340/545.9; 340/330; 340/528; 340/541

(58) Field of Search ..... 340/541, 550, 340/545.1, 545.9, 825.06, 825.31, 825.32, 286.01, 286.02, 286.11, 293, 326, 328, 330, 331, 332, 506, 565, 528, 430

(56) References Cited

U.S. PATENT DOCUMENTS

| | | | | |
|---|---|---|---|---|
| 4,114,147 | * | 9/1978 | Hile | 340/528 |
| 4,257,038 | * | 3/1981 | Rounds et al. | 340/539 |
| 4,459,582 | * | 7/1984 | Sheahan et al. | 340/528 |
| 4,821,027 | * | 4/1989 | Mallory et al. | 340/539 |
| 5,801,625 | * | 9/1998 | Wang | 340/528 |

* cited by examiner

*Primary Examiner*—Brent A. Swarthout
(74) *Attorney, Agent, or Firm*—Raymond Y. Chan; David and Raymond Patent Group

(57) ABSTRACT

An auxiliary alert process and system thereof for alarm system are adapted for monitoring all the devices, so that a great amount of installation fee and equipment cost can thus be saved, wherein the auxiliary alert process which includes the following steps. (1) Maintain at least a sensor installed at an entrance or an exit of an existing alarm system in functioning condition when the alarm system is disarmed. (2) Monitoring the entrance/exit by the sensor to determine whether there is a motion occurred at the monitoring entrance/exit. (3) Send a detected signal to a security control device which is connected between a control panel and the sensor of the alarm system when the sensor detects the intruding motion occurred at the monitoring entrance/exit, and trigger at least a local warning device by the security control device to generate an alert signal. (4) Stop the alert signal when the intruding motion ceases or terminates. (5) Disable the security control device by switching the sensor to the control panel of the alarm system when the alarm system is armed, so that the sensor performs its alarm detecting function normally.

11 Claims, 3 Drawing Sheets

AUXILIARY ALERT PROCESS AND SYSTEM THEREOF FOR ALARM SYSTEM

FIELD OF THE PRESENT INVENTION

The present invention relates to alarm system, and more particularly to an auxiliary alert process and system thereof for alarm system that enables the alarm system to have an additional function of monitoring the entrance/exit when the alarm system is disarmed.

BACKGROUND OF THE PRESENT INVENTION

In order to prevent intruders, most commercial buildings, office buildings, industry structures, and residential houses have installed security or burglary alarm systems. Normally, during the business hours or when the owner is still staying inside the structure, the alarm system is disarmed. After the business hours or when there is nobody inside the structure, the owner will set the alarm system in armed condition before he or she leaves.

Pursuant to the current National Life Safety/Fire codes, all the emergence entrances or exits of a commercial structure or public area such as warehouses or stairways must remain unlocked 24 hours a day for safety purposes. Therefore, some buildings such as warehouses or factories must keep their entrances and exits unlock even when their alarm systems are disarmed during the business hours. It is unreasonable to have security guards monitoring all the unlocked entrances or exits during the business hours. Think about that if your home door must remain unlock when you are at home, it is absolutely not a secure matter. To those huge size warehouses, valuable goods are stored therein. Also, to those business buildings, valuable properties or expensive equipements are everywhere. However, all kinds of intruder are free to enter and exit such unlocked entrances or exits anytime. Therefore, how to laborlessly monitor such unlocked entrances or exits becomes the first topic to those buildings and structures.

It seems to be the only solution to reduce the necessary number of security guards being hired by installing at every unlocked entrances and exits with expensive video camera, additional security devices and individual systems such as door exit alarms or door push bar alarm devices. However, to monitor numbers of monitoring screens simultaneously in the security room without any mistake is impossible. An intruder may easily enter the structure even when the security guard moves his or her eyes away from the corresponding monitoring screen or the passive VCR recording system for seconds. Moreover, if the conventional battery operated individual push bar alarm device is installed at the entrance/exit door, the user must test the push bar alarm device periodically to ensure whether it is functioning normally. In conclusion, the conventional security method is expensive but inefficient.

Also, pursuant to the National Building Codes, if there is a swimming pool within a housing area, for children safety, all passages and exits that can reach the swimming pool must provide alert system to generate alert signals when that exit door is opened every time. The main objective of this regulation is to prevent the minors or seniors in a family from being accidentally fallen into the swimming pool and drown. However, although every exit door has installed a door sensor if an alarm system is installed to protect the housing area, the alarm system is normally disarmed when the residents are at home. In other words, all the door sensors will not function when there is any resident at home.

Besides, an armed alarm system will only provide continuous alert siren even when the owner himself or herself open the door.

Accordingly, the swimming pool owner must install expensive additional door alarm systems and/or individual warning or guarding systems to all the exit doors. Independent buzzer is also required to be install at home to provide alarm for such as 30 seconds when any one of the additional door sensors is triggered so as to warn the house owner that the exit door is opened and a minor may have the chance to reach the swimming pool. Although it sounds like a stupid thing to install two door alarm systems at one door, it is the only solution currently.

SUMMARY OF THE PRESENT INVENTION

It is a main object of the present invention to provide an auxiliary alert process and system thereof for alarm system which is adapted for monitoring all the entrances and exits without the needs of installing any additional sensor or alert device, so that a great amount of installation fee and equipment cost can thus be saved.

It is another object of the present invention to modify the existing alarm system to additionally become the entrance/exit monitoring security system when the alarm system is disarmed and not in use.

It is another object of the present invention to provide an auxiliary alert process and system thereof for alarm system that can monitor the condition of the exit doors and provide audio or visual alert signals for handicaps once the exit door is opened so as to meet the requirements of the National Building Codes.

It is another object of the present invention to provide an auxiliary alert process which can be applied to the traditional alarm system for monitoring all the entrances and exits without the needs of installing any additional sensor or alert device.

It is another object of the present invention to provide an auxiliary alert system which can be equipped with an existing alarm system for monitoring all the entrances and exits without the needs of installing any additional sensor or alert device.

It is also another object of the present invention to provide an auxiliary alert process and system thereof for alarm system, wherein the door sensors of the currently installed security alarm system themselves are also used as the monitoring sensor of those exit doors when the alarm system is disarmed. However, when the alarm system is armed, the door sensors will normally function and work as the alarm sensors.

It is yet another object of the present invention to provide an auxiliary alert process and system thereof for alarm system, that can provide a more active and functionable exit door security function in low cost for the commercial buildings (such as warehouses) or the house having swimming pool by using the same control panel and enabling the currently installed security alarm system to additional function as an exit security device.

It is still another object of the present invention to provide an auxiliary alert process and system thereof for alarm system, which is easy to install and cheap in cost.

Accordingly, in order to accomplish the above objects, the present invention provides an auxiliary alert process for alarm system, which comprises the steps as follows:

(1) Maintain the sensor in functioning condition when the alarm system is disarmed.

(2) Monitoring the entrance/exit by the sensor to determine whether there is an intruding motion occurred at the entrance/exit.

(3) Trigger at least a local warning device of the alarm system to generate an alert signal when the sensor detects the intruding motion occurred at the entrance/exit.

(4) Stop the alert signal when the intruding motion ceases or elimninates.

(5) Switch the sensor to the control panel of the alarm system when the alarm system is armed, so as to render the sensor performing its alarm detecting function normally.

To process the above auxiliary alert process, an auxiliary alert system is employed, wherein the auxiliary alert system comprises a security control device connected between at least a designated sensor and a control panel of an existing alarm system. Alternatively, the security control device can also be built in the control panel of the alarm system.

The security control device comprises a central processor unit, an input circuit for electrically connecting at least the designated sensor of the alarm system to the central processor unit, a power supply electrically connected to the central processor unit for providing electrical power to the central processor unit, a time count generator electrically connected to the central processor unit for generating counter signals, a PG selector which is a switch circuit for setting the central processor and selecting and programming time period, an alarm output for connecting to a local warning device for generating alert signal, an output circuit for electrically connecting the central processor unit with the control panel of the alarm system, and a status controlling circuit for determining whether the alarm system is armed or disarmed. Whereby, when the alarm system is armed, the PC selector bypasses the detecting signal sent from the designated sensor directly to the control panel of the alarm system to function normally. However, when the alarm system is disarmed, the detecting signal sent from the designated sensor is transmitted to the security control device wherein the central processor unit triggers the alarm output to generate the alert signal which can be audio and/or visual warning signal.

DETAILED DESCRIPTION OF THE PREFERRED EMBODIMENT

Figure 2:
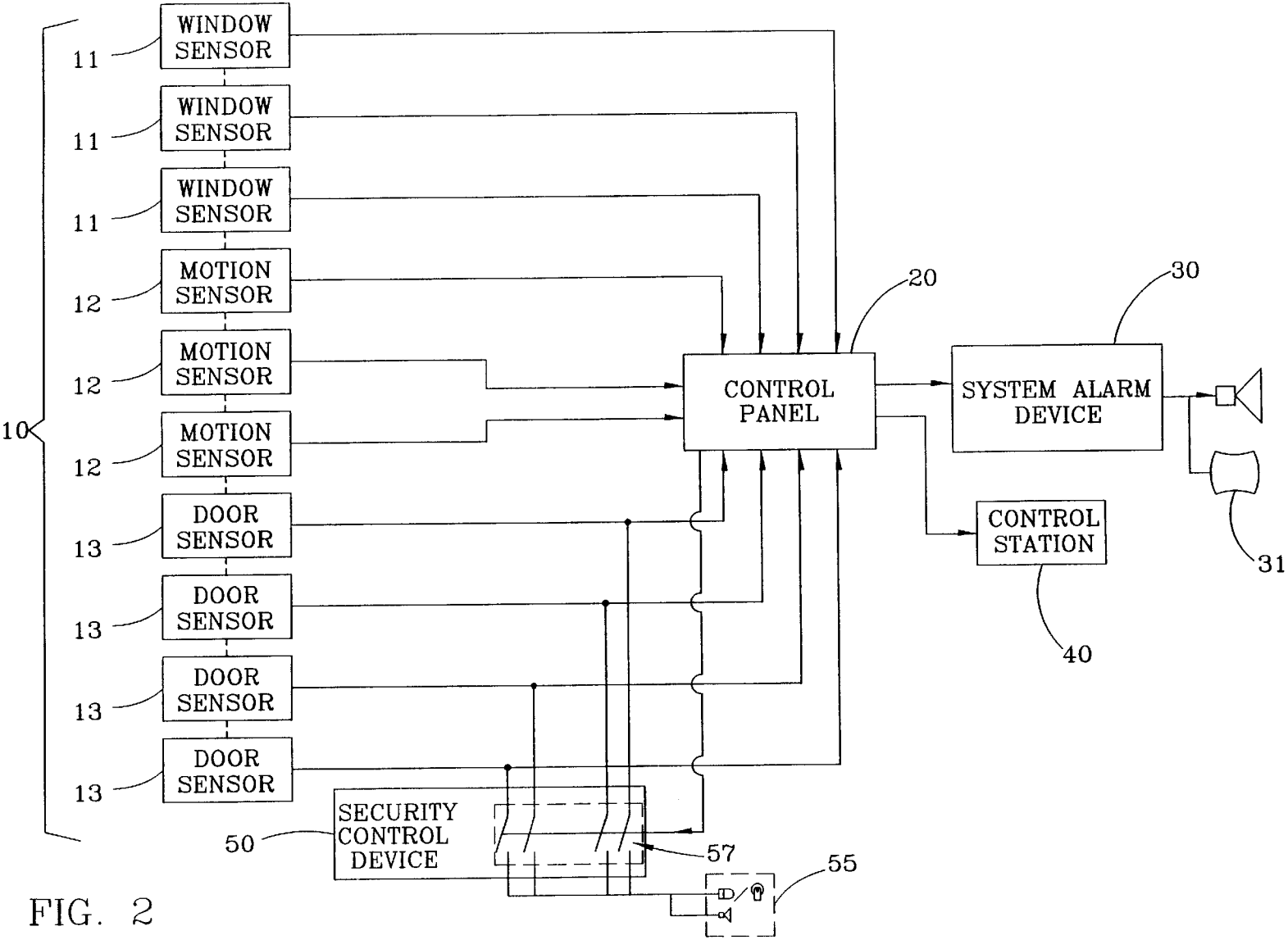
FIG. 2 is a schematic block diagram of an auxiliary alert system according to a preferred embodiment of the present invention, illustrating how the security control device of the present invention relates with the sensors and the control panel of an existing alarm system.

Referring to FIG. 2, practically, an alarm system installed in a structure comprises a plurality of sensors 10, such as window sensors 11, motion sensors 12 and entrance/exit sensors 13, to detect any unauthorized intruding motion during armed condition. Such entrance/exit sensor 13 which can be a motion sensor, an infra-red sensor, or door sensor such as magnet switch, which are normally electrically connected to a control panel 20 of the alarm system. The control panel 20 processes any signal received from all kinds of monitoring sensors 10 connected thereto and determines when to trigger a system alarm device 30 such as a siren 31 to generate warning siren and/or a dialer to automatically dial to the security control center and designated police station 40.

In order words, every entrance/exit door in a commercial building, warehouse or residential house has already been installed with, normally, a door sensor 13. The door sensor 13 is generally in standby condition when the door is close. Once the door is opened, a detected signal will be sent from the door sensor 13 to the control panel 20. If, at that moment, the alarm system is disarmed, the control panel 20 will not trigger the system alarm device 30. However, when the alarm system is in armed condition, the control panel will trigger the system alarm device 30 to activate the siren 31.

Accordingly, the subject concept of the present invention is to use the same entrance/exit sensor 13 of the existing alarm system to function as a security monitoring sensor when the alarm system is in disarmed condition, so that the owner needn't waste the expense to purchase and install additional monitoring sensors, controlling systems or devices for the entrances or exits.

Figure 1:
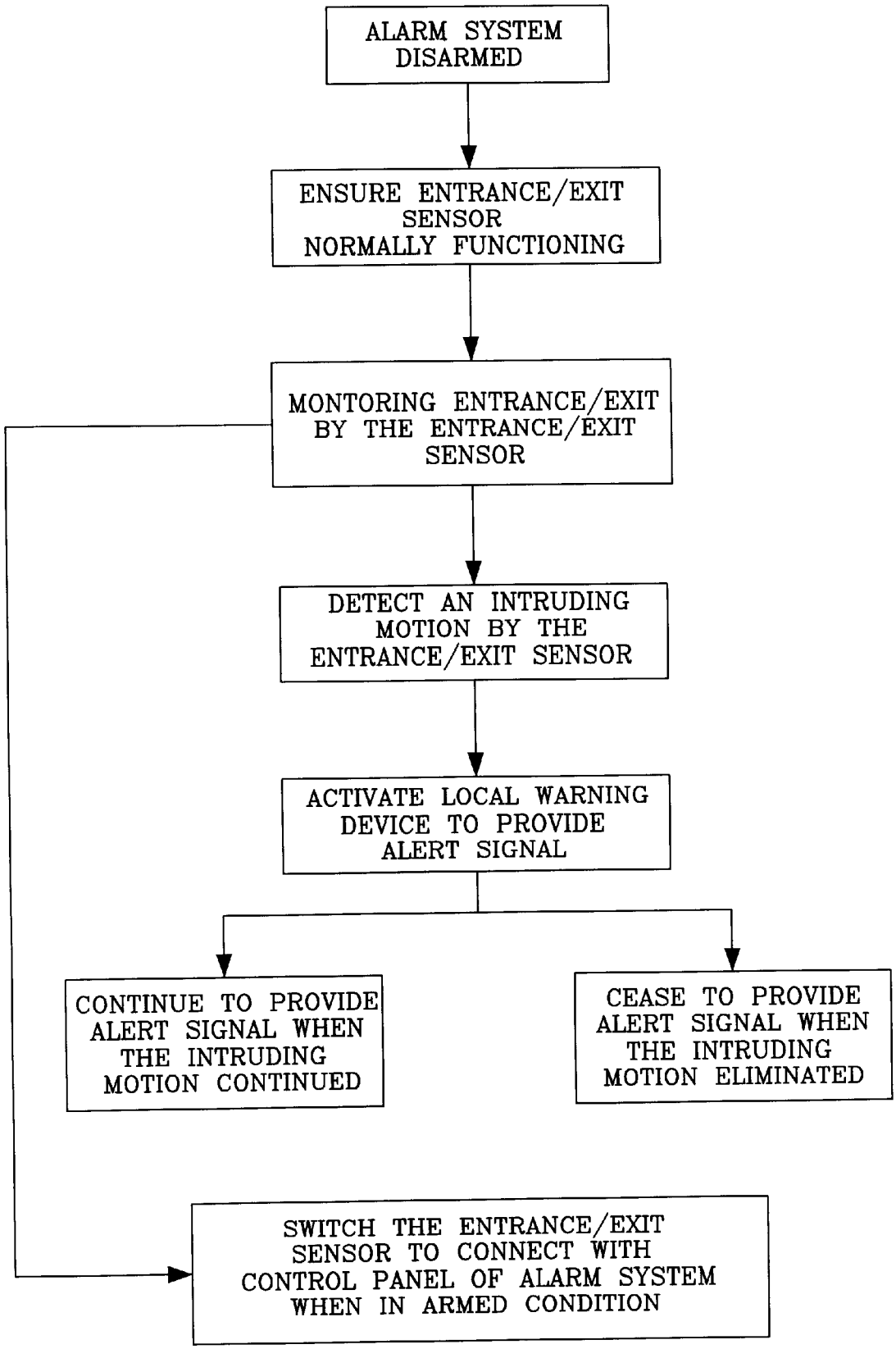
FIG. 1 is a block diagram of an auxiliary alert process of the present invention.

Referring to FIG. 1, an auxiliary alert process for alarm system of the present invention is illustrated, which comprises the following steps.

(1) Maintain at least a sensor installed at an entrance/exit of an existing alarm system in functioning condition when the alarm system is disarmed.

(2) Monitor the entrance/exit by the sensor to determine whether there is a motion occurred at the monitoring entrance/exit.

(3) Trigger at least a local warning device of the alarm system to generate an alert signal when the sensor detects the motion occurred at the entrance/exit.

(4) Stop the alert signal when the motion ceases or terminates.

(5) Switch the sensor to the control panel of the alarm system when the alarm system is armed, so as to render the sensor performing its alarm detecting function normally.

In step (1), the sensor can be a switch-type. If the sensor is an electrical sensor, such as infra-red sensor, the normal function of the sensor is maintained by continuously providing electrical power to the sensor installed at the entrance/exit of the existing alarm system.

Moreover, in step (1), if the sensor is a door sensor, the door sensor in step (2) will remain in standby condition and send out detecting signal once the door is opened. In other words, the opening action of the door is considered as the motion occurred at the monitoring entrance/exit.

In step (2), the sensor can also be an infra-red motion sensor, wherein when a moving object such as a person moves through the entrance/exit, the infra-red motion sensor detects and processes the step (3) by sending out the detecting signal to the security control device.

In step (3), when the sensor detects the motion occurred at the monitoring entrance/exit, a detecting signal is sent to a security control device which can be a built-in system employed in a control panel of the alarm system or an independent device connected between the control panel and the sensor of the alarm system, so that the local warning device is triggered by the security control device to generate the alert signal.

Step (4) comprises the steps of (4-1) continuously generating alert signal when the door is remain opened, and (4-2) generating alert signal for a predetermined period of time such as 30 seconds when the opened door is closed. In other words, when the door is opened and then closed immediately, the alert signal will last for a delay time, i.e. more than or equal to 30 seconds.

In step (5), the security control device is disabled by switching the sensor to the control panel of the alarm system when the alarm system is armed, therefore the sensor performs its alarm detecting function normally.

In step (5), the security control device will automatically disable its functions once the alarm system is set to armed condition, so that the sensor will work normally with the control panel when the alarm system is in armed condition. Once the alarm system is disarmed, in step (2), the security control device will automatically detect the disarmed condition and function to monitoring the entrance/exit.

In step (3) the local warning device can be the system siren of the alarm system or an additional device including a buzzer, a visual device such as alert lighting, and/or a multi-channel voice control device which can provide pre-recorded warning voice messages when triggered.

Figure 3:
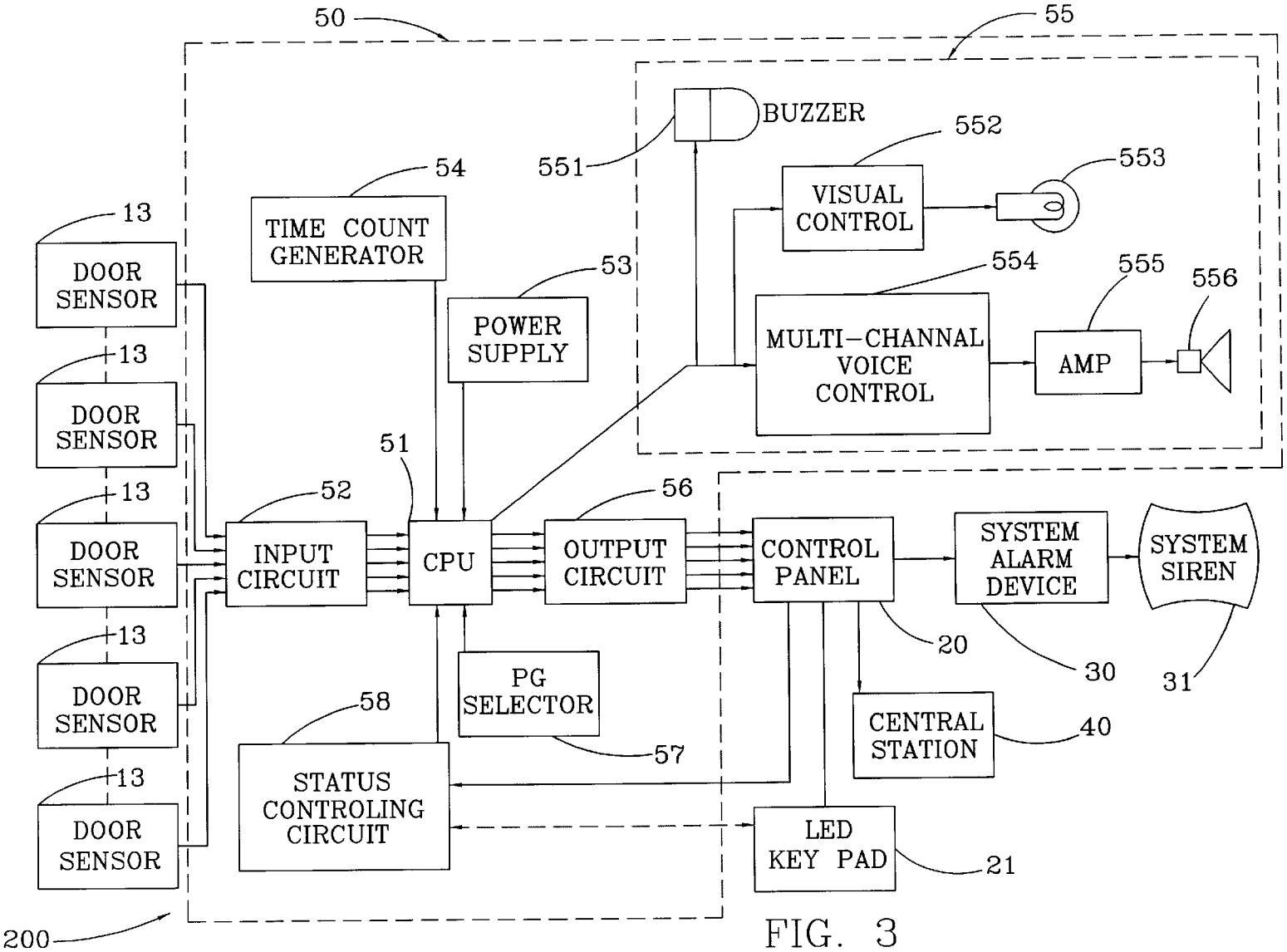
FIG. 3 is a block diagram illustrating a preferred configuration of the auxiliary alert system according to the above preferred embodiment of the present invention.

To process the above auxiliary alert process, an auxiliary alert system is employed. As shown in FIG. 3, the auxiliary alert system comprises a security control device 50 which can be a system built in the control panel or even employed in the central processor unit of the control panel of an existing alarm system.

Referring to FIGS. 2 and 3, the security control device 50 is embodied to be connected between at least a designated entrance/exit sensor 13 and a control panel 20 of the existing alarm system.

The security control device 50 comprises a central processor unit 51 which can be a central controlling computer or a micro processor unit for computation and loading designated software, an input circuit 52 for electrically connecting at least one designated entrance/exit sensor 13 of the alarm system to the central processor unit 51, a power supply 53 electrically connected to the central processor unit 51 for providing electrical power to the central processor unit 51, a time count generator 54 electrically connected to the central processor unit 51 for generating counter signals, an alarm output 55 for connecting to a local warning device 551 for generating alert signal, an output circuit 56 for electrically connecting the central processor unit 53 with the control panel 20 of the alarm system, a PG selector 57 which is a switch circuit for setting the central processor unit 51 to select and program time period and function, and a status controlling circuit 58 for determining whether the alarm system is armed or disarmed.

Whereby, when the alarm system is armed, the PG selector 57 bypasses the detecting signal sent from the designated sensor 13 directly to the control panel 20 of the alarm system to function normally. However, when the alarm system is disarmed, the detecting signal sent from the designated sensor 13 is input into the central processor unit 51 of the security control device 50 wherein the central processor unit 51 triggers the alarm output 55 to generate the alert signal that can be audio and/or visual warning signal.

Unlimited number of entrance/exit sensors 13 can be connected to the security control device 50, depending on the size of the central processor unit 51. According to the present invention, door sensors are embodied as the entrance/exit sensors 13.

According to the present invention, in order to provide a security monitoring function to all the entrances or exits, the owner has no need to purchase and install additional entrance/exit sensor at the entrances or exits, and thus a great amount of installation labor and equipment cost can be saved. The owner also does not need to modify the alarm system. In fact, the owner merely needs to connect the independent security control device 50 between all the designated entrance/exit sensors 13 of the alarm system and the control panel 20.

The owner can simply plug the end terminals of all the designated entrance/exit sensors to connect to the input circuit 52 of the security control device 50 and connect the output circuit 56 of the security control device 50 with the control panel 20 of the alarm system. Then, the installation is completed. It is so easy and convenience, adapting to "Do It Yourself".

The PG selector 57 acts as a switch circuit for the connection between the entrance/exit sensors 13 and the control panel 20. The status controlling circuit 58 is also connected to the control panel 20, so that when the alarm system is armed or disarmed by the owner, the status controlling circuit 58 can detect and trigger the control processor unit 51 to disfunction or function accordingly. Also the status controlling circuit 58 can also be simply connected to a LED keypad 21 of the alarm system instead of connecting to the control panel 20, as shown in the phantom line in FIG. 3. Since the owner must key in a code through the LED keypad 21 when he or she wants to arm or disarm the alarm system. Therefore, the armed or disarmed condition of the alarm system can also be detected from the LED keypad 21 by the status controlling circuit 58.

When the status controlling circuit 58 detects that the alarm system is disarmed, the central processor unit 51 activates the PG selector 57 to switch off the connection between the entrance/exit sensors 13 and the control panel 20 of the alarm system. Therefore, the detecting signals from the entrance/exit sensors 13 are processed by the central processor unit 51. When any one of the entrance/exit sensors 13 (e.g. the door sensor) detects an opening motion of the door, the central processor unit 51 will trigger the alarm output 55 to activate and output visual and/or audio warning signals.

When the status controlling circuit 58 detects that the alarm system is in armed condition, the central processor unit 51 activates the PG selector 57 to bypass the security control device 50 and switch to directly connect the entrance/exit sensors 13 to the control panel 20, so that the entrance/exit sensors 13 and the control panel 20 work normally as if the security control device 50 is not here.

The central processor unit 51 will continuously activate the alarm output 55 to generate alert signal when the door is remain opened. However, when the opened door is closed again, the time count generator 54 starts to count a predetermined period of warning time. During the period of warning time, the central processor unit 51 activates the alarm output 55 to generate alert signal. Once the time count generator 54 finishes the warning time counting, the central processor unit 51 will deactivate the output alarm 55 to cease the alert signal. Normally, the period of warning time can be set to have 30 seconds. In other words, when the door is opened and then closed immediately, the alert signal will last for a delay time such as 30 seconds or more than 30 seconds to meet the requirements of the National Building Codes.

As suggested above, the alarm output 55 can be simply connected to the local system alarm such as the siren 31 of the alarm system to save equipment cost. However, such as when the security control device 50 is used as a swimming pool security guard, the owner may like to have warning alert provided at a location other than where the local system alarm located. The owner may want warning signals being provided in the kitchen or the living room, so that he or she can immediately respond when an exit door to the swimming pool is opened for safety purposes. Also, the owner of a warehouse may also want to have warning signals provided in the administration office, so that every employee can immediately target the alarming zone and quickly respond to any authorized intruding at the unlocked entrance/exit door.

Moreover, in order to distinguish from the normal alarm warning siren, the alarm output 55 of the present embodiment comprises a buzzer 551 for providing short beeping sounds to meet the requirements of the National Building Codes. For handicapped requirement, the alarm output 55 may further comprises a visual control 552 connected to at least an alert lighting 553 to provide warning light, and/or a multi-channel voice control 554 which is connected to an amplifier 555 and speakers 556 for generating voice warning messages. The user may prerecord a music or a voice message, such as "CHECK THE SWIMMING POOL", "SOMEONE AT THE REAR EXIT", etc., in the multi-channel voice control 554. Since every entrance/exit sensor is individually connected to the input circuit 52 and then the central processor unit 51, the central processor unit 51 can easily distinguish the exact entrance/exit sensor 13 that sending the detecting signal thereto. Therefore, the alarm output 55 may provide a plurality of buzzers 551 or alert lightings 553 to represent the different locations of the entrance/exit sensors 13 respectively. The central processor unit 51 may precisely trigger the corresponding buzzer 551 or alert lighting 553 to indicate and provide respective warning signal. Or, the central processor unit 51 may trigger the multi-channel voice control 554 to provide the corresponding voice message to indicate the exact location of the opened door.

By means of the auxiliary alert process and system of the present invention, the warehouse owners and the swimming pool owners can easily achieve the entrance/exit monitoring function through the existing disarmed alarm system. No extra expense and installation is required. In conclusion, the present invention can virtually achieve the following advantages:

1. The present invention is adapted for monitoring all the entrances and exits without the needs of installing any additional sensor or individual alert device, so that a great amount of installation fee and equipment cost can thus be saved.

2. The present invention simply modifies the existing alarm system to also become the entrance/exit monitoring security system when the alarm system is disarmed and not in use.

3. It can self-very the condition of the exit doors and provide audio or visual alert signals once the exit door is opened.

4. The door sensors of the currently installed alarm system themselves are also used as the monitoring sensor of those exit doors when the alarm system is disarmed. However, when the alarm system is armed, the door sensors will normally function and work as the alarm sensors.

5. It can provide the exit door security function for the commercial buildings such as warehouse or the house having swimming pool in low cost by using the same control panel and enabling the currently installed alarm system to additional function as an exit security device.

6. It can upgrade the existing alarm system by equipping the present invention with the existing alarm system to additionally provide the monitoring features of all the entrances and exits without the needs of installing any additional sensor or individual alert device.

7. It can more accurately located the intruding zone through the keypad of the alarm system that the status controlling circuit of the present invention connected thereto.

8. It is easy to install and cheap in cost.

What is claimed is:

1. An auxiliary alert process of an existing alarm system, which is currently installed in a structure for general security purpose, having at least an entrance/exit sensor installed at an entrance/exit of said structure, comprising the following steps:

(a) maintaining said entrance/exit sensor installed at said entrance/exit of said existing alarm system in functioning condition when said existing alarm system is in a disarmed condition;

(b) monitoring said entrance/exit by said entrance/exit sensor to determine whether there is an intruding motion occurred at said entrance/exit;

(c) triggering at least a local warning device of said existing alarm system to generate an alert signal when said entrance/exit sensor detects said intruding motion occurred at said entrance/exit;

(d) stopping said alert signal when said intruding motion ceases or terminates; and (e) switching said entrance/exit sensor to a control panel of said existing alarm system when said existing alarm system is in an armed condition, so as to render said entrance/exit sensor performing a normal alarm detecting function thereof, wherein a detecting signal is sent to a security control device connected between a control panel and said entrance/exit sensor of said existing alarm system when said entrance/exit sensor detects said intruding motion occurred at said entrance/exit so as to trigger said local warning device by said security control device to generate said alert signal, wherein said security control device automatically disables functions thereof once said existing alarm system is set to said armed condition, wherein said entrance/exit sensor works normally with said control panel when said existing alarm system is in said armed condition;

wherein said security control device comprises:

a central processor unit for computation, an input circuit for electrically connecting said entrance/exit sensor of said existing alarm system to said central processor unit, a power supply electrically connected to said central processor unit for providing electrical power to said central processor unit, a time count generator electrically connected to said central processor unit for generating counter signals for controlling a predetermined period of time for said alert signal, an alarm output for connecting to said local warning device for generating said alert signal, an output circuit for electrically connecting said central processor unit with said control panel of said existing alarm system, a PG selector which is a switch circuit for setting said central processor unit to select and program time period and function, and a status controlling circuit for determining whether said existing alarm system is armed or disarmed, wherein when said existing alarm system is armed, said PG selector bypasses said detecting signal sent from said entrance/exit sensor directly to said control panel of said existing alarm system to function normally, and when said existing alarm system is disarmed, said detecting signal sent from said entrance/exit sensor is input into said central processor unit of said security control device, wherein said central processor unit triggers said alarm output to generate said alert signal.

2. An auxiliary alert system, comprising a security control device connected between at least an entrance/exit sensor and a control panel of an existing alarm system which is currently installed in a structure for general security purpose, wherein said entrance/exit sensor of said existing alarm system is installed at an entrance/exit of said structure, wherein said security control device comprises:

a central processor unit for computation, an input circuit for electrically connecting said entrance/exit sensor of said existing alarm system to said central processor unit, a power supply electrically connected to said central processor unit for providing electrical power to said central processor unit, a time count generator electrically connected to said central processor unit for generating counter signals for controlling a predetermined period of time for said alert signal, an alarm output for connecting to a local warning device of said existing alarm system for generating alert signal, an output circuit for electrically connecting said central processor unit with said control panel of said existing alarm system, a PG selector which is a switch circuit for setting said central processor unit to select and program time period and function, and a status controlling circuit for determining whether said existing alarm system is armed or disarmed;

wherein when said existing alarm system is armed, said PG selector bypasses a detecting signal sent from said entrance/exit sensor directly to said control panel of said existing alarm system to function normally, and that when said existing alarm system is disarmed, said detecting signal sent from said entrance/exit sensor is input into said central processor unit of said security control device, wherein said central processor unit triggers said alarm output to generate said alert signal.

3. An auxiliary alert system, as recited in claim 2, wherein said status controlling circuit is also connected to said control panel, wherein when said alarm system is armed or disarmed, said status controlling circuit detects and triggers said central processor unit to disfunction or function accordingly.

4. An auxiliary alert system, as recited in claim 2, wherein said PG selector is a switch circuit for said connection between said entrance/exit sensors and said control panel, wherein when said status controlling circuit detects that said existing alarm system is disarmed, said central processor unit activates said PG selector to switch off said connection between said entrance/exit sensors and said control panel of said existing alarm system, therefore said detecting signal from said entrance/exit sensor is processed by said central processor unit, therefore when said entrance/exit sensor detects a human motion, said central processor unit triggers said alarm output to activate and output visual and audio warning signals, besides when said status controlling circuit detects that said existing alarm system is in an armed condition, said central processor unit activates said PG selector to bypass said security control device and switch to directly connect said entrance/exit sensor to said control panel, so that said entrance/exit sensor and said control panel work normally.

5. An auxiliary alert system, as recited in claim 4, wherein said PG selector is a switch circuit for said connection between said entrance/exit sensors and said control panel, wherein when said status controlling circuit detects that said existing alarm system is disarmed, said central processor unit activates said PG selector to switch off said connection between said entrance/exit sensors and said control panel of said existing alarm system, therefore said detecting signal from said entrance/exit sensor is processed by said central processor unit, therefore when said entrance/exit sensor detects a human motion, said central processor unit triggers said alarm output to activate and output visual and audio warning signals, besides when said status controlling circuit detects that said existing alarm system is in an armed condition, said central processor unit activates said PG selector to bypass said security control device and switch to directly connect said entrance/exit sensor to said control panel, so that said entrance/exit sensor and said control panel work normally.

6. An auxiliary alert system, as recited in claim 2, wherein said alarm output comprises a buzzer connected thereto for providing short beeping sound.

7. An auxiliary alert system, as recited in claim 2, wherein said alarm output comprises a visual control connected to at least an alert lighting to provide warning light.

8. An auxiliary alert system, as recited in claim 5, wherein said alarm output comprises a visual control connected to at least an alert lighting to provide warning light.

9. An auxiliary alert system, as recited in claim 2, wherein said alarm output comprises a multi-channel voice control which is connected to an amplifier and speakers for generating voice warning messages.

10. An auxiliary alert system, as recited in claim 5, wherein said alarm output comprises a multi-channel voice control which is connected to an amplifier and speakers for generating voice warning messages.

11. An auxiliary alert system, as recited in claim 8, wherein said alarm output comprises a multi-channel voice control which is connected to an amplifier and speakers for generating voice warning messages.

* * * * *